US008381339B2

(12) United States Patent
Knapp

(10) Patent No.: US 8,381,339 B2
(45) Date of Patent: Feb. 26, 2013

(54) COMBAT/SURVIVAL KNIFE WITH EJECTABLE, SELF-CONTAINED GEAR COMPARTMENT

(75) Inventor: Mark Steele Knapp, Fairbanks, AK (US)

(73) Assignee: Mark Steele Knapp, Fairbanks, AK (US)

( * ) Notice: Subject to any disclaimer, the term of this patent is extended or adjusted under 35 U.S.C. 154(b) by 209 days.

(21) Appl. No.: 13/025,148

(22) Filed: Feb. 10, 2011

(65) Prior Publication Data

US 2012/0204354 A1 Aug. 16, 2012

(51) Int. Cl.
*B26B 11/00* (2006.01)
*B26B 3/00* (2006.01)

(52) U.S. Cl. ..... 7/158; 30/138

(58) Field of Classification Search ..... 7/158, 167, 7/106; 81/177.4, 490, 49; 30/123, 138
See application file for complete search history.

(56) References Cited

U.S. PATENT DOCUMENTS

| | | | | |
|---|---|---|---|---|
| 912,411 | A * | 2/1909 | Putney | 30/144 |
| 3,760,438 | A * | 9/1973 | White | 7/106 |
| 6,782,576 | B1 * | 8/2004 | Valencic et al. | 7/158 |
| 8,037,577 | B2 * | 10/2011 | Chen | 81/490 |
| 2004/0094000 | A1 * | 5/2004 | Liao | 81/490 |

* cited by examiner

*Primary Examiner* — Hadi Shakeri

(57) ABSTRACT

A fixed blade knife that is intended for survival or tactical use is provided with a removable, ejectable, self contained compartment for the storage and carriage of survival and/or tactical gear within the handle of the knife. A self contained, removable compartment is superior to a separate butt cap for the handle as a butt cap requires the use of two functioning hands for removal, is not as fast as an ejectable compartment and can be lost rendering the handle useless for the storage and carriage of gear. The self contained compartment eliminates the necessity for a butt-cap, can be ejected quickly with a single digit that may or not be otherwise useless due to injury or environmental conditions. The compartment also serves to contain the gear there-in separate from the knife handle to prevent loss and allow use of said gear by a second individual while the knife itself may be in use by the primary user.

3 Claims, 3 Drawing Sheets

COMBAT/SURVIVAL KNIFE WITH EJECTABLE, SELF-CONTAINED GEAR COMPARTMENT

BACKGROUND OF THE INVENTION

1. Field of the invention

This invention relates to fixed blade knives with capacity for storage and carriage of survival or tactical gear and particularly a removable, self-contained, ejectable compartment for said gear in the handle.

2. Description of related art

Knives with survival or tactical gear in their handles have been used for many years. The user can store gear in the handle and have it readily available for use at any time. Things like, a knife sharpener, a fire starter, a lighter, fish hooks and line or a flashlight can be carried conveniently.

There are no U.S. Patents found with knives of similar design, however many examples of knives with storage capacity in the handles are available. With these designs it is necessary to have two functioning hands to access gear within the handle. The gear stored in the handle must be accessed by removing a separate butt-cap. A separate butt cap is inferior to the present invention as it can be lost, rendering the storage capacity of the handle useless. Also, gear held loosely in the handle, as in all prior examples, requires the user to empty all of the contents to a suitable area to choose the implement needed.

Many times in the field a clean area to empty the handles to access the gear inside is not available, users are surrounded by leaf and foliage covered ground, snow or over water as on a dock or in a boat. Loss of important survival or tactical gear is possible. Nimble fingers and good visibility are required to thread the butt-cap back onto the handle.

BRIEF SUMMERY OF THE INVENTION

The present invention overcomes all of the difficulties mentioned above. First, it has a single button that releases the compartment. The compartment is ejected partially from the knife handle by spring pressure. The button can be depressed with a single digit of the hand easily whether the user has impaired use and control of his fingers due to injury, frost bight or hypothermia. Second, it has no butt-cap to be lost. Third, all the gear is remains within the compartment after it is removed from the handle of the knife, a particular implement or tool can be selected and the compartment returned to the handle of the knife for safety. Fourth, the compartment can be easily returned to it's place within the handle of the knife without the need for good visibility or properly functioning fingers. It slides in with little pressure till fully seated within the handle where it is retained by the compartment release button.

DETAILED DESCRIPTION OF THE INVENTION

Figure 1:
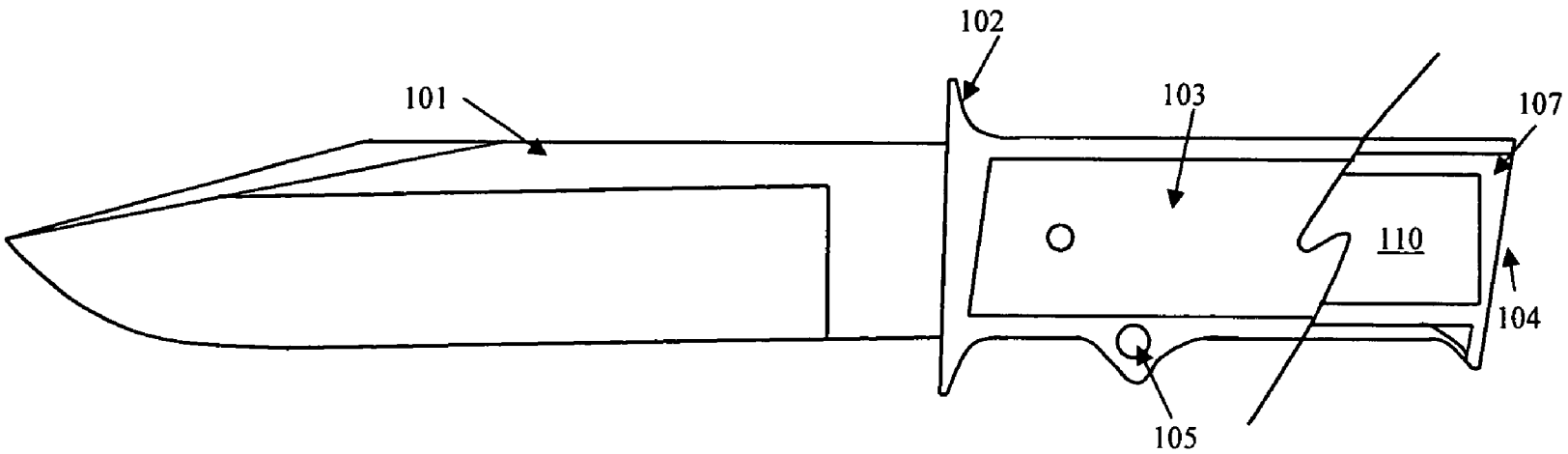
FIG. 1 is a partially cut-away side view of the invention with the removable compartment installed.

Referring to FIG. 1, the partially cut-away side view of the instant invention is shown. The knife has a blade 101, with or without a guard 102, and a handle 103. The invention has a threshold 104 at the base of the handle to allow the insertion of the removable compartment 107 and a compartment catch/release button 105 to retain and release the compartment. The compartment is provided with a diamond, knife sharpening hone 101 that serves dual purpose as a door, to hold survival/tactical gear within the compartment.

Figure 2:
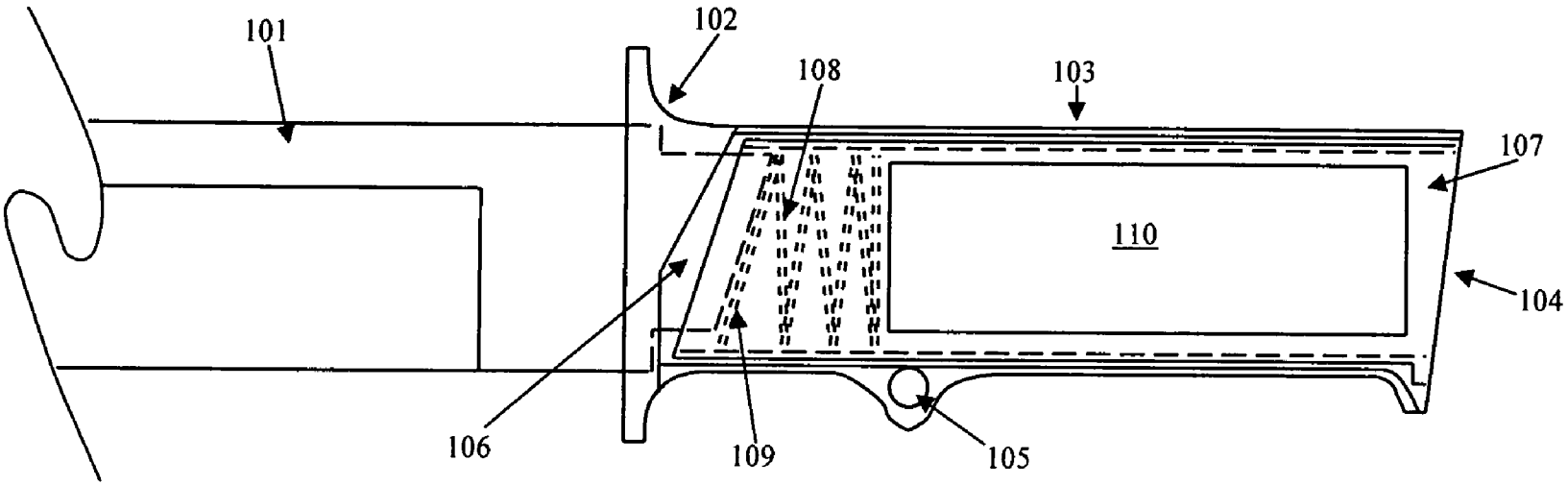
FIG. 2 is a cut-away view of the handle with the compartment installed.

FIG. 2 shows a full size, cut-away, side view of the handle with the gear compartment 107 installed. It has an ejector spring 108 and push plate 109 to partially eject the compartment when the compartment catch/release button is depressed. The door 110 of the compartment is a diamond knife/fishhook sharpening hone.

Figure 3:
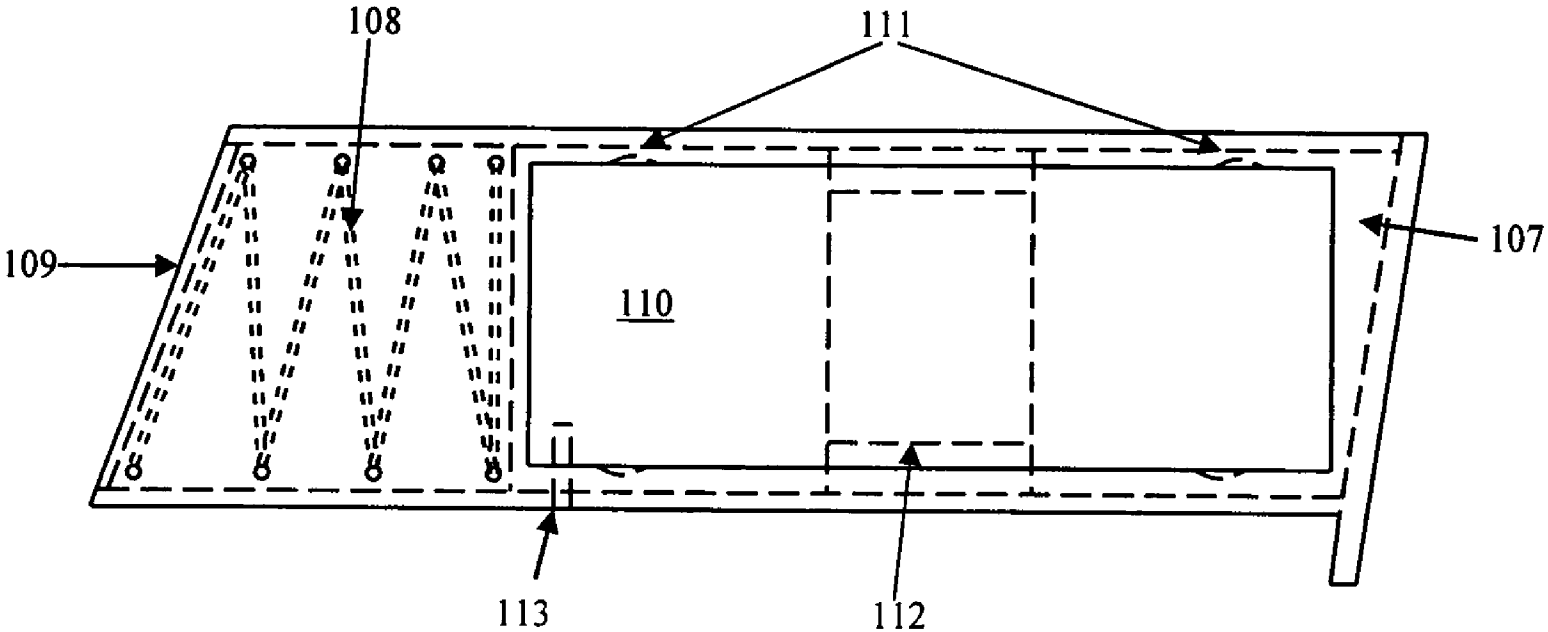
FIG. 3 is a side view of the compartment.

FIG. 3 is a side view of the compartment; it shows the ejector spring 108 and the push plate 109. It also shows the compartment door 110 in place. The door has two tabs 111 on each of its long sides and a flat spring 112 inside the compartment, to hold it in place in the opening of the compartment. The compartment is also provided with a detent 113 to engage the compartment catch/release button when the compartment is introduced fully into the knife handle.

It may be noted that for the purposes of economic production and because they are at times readily available surplus parts of common handguns are re-purposed in the manufacture of the current invention, the present disclosure should not be construed to limit the invention to the use of re-purposed gun parts in its construction nor should it be construed to limit the use of newly manufactured parts.

The present disclosure should also not be construed to limit the invention in any way other than that limited by the scope of the claims herein and may be subject to changes or modifications by skilled persons within the scope of the invention without departing from the concept thereof.

I claim:

1. A survival knife comprising:

a fixed blade;

a handle having a threshold at a base of the handle;

a removable compartment for the containment of one or more of survival or tactical items, wherein the removable compartment is inserted within said handle via said threshold;

a catch button to retain and allow for removal of said compartment;

wherein said removable compartment comprises a spring and a push plate to facilitate partial ejection of said compartment form the handle when said catch button is depressed; and wherein said removable compartment comprises a door having a diamond grit outer surface to serve dual purpose as a hone, and further includes tabs and a spring to hold said door in place in a door opening of the compartment.

2. A survival knife according to claim 1, wherein the one or more of the survival or tactical items contained within the compartment includes a flashlight, a fire starter, a small multitool, a can opener, fish hooks, fish line, snare wire, bow string, arrow heads, sewing needle or a combination thereof.

3. A survival knife according to claim 1, wherein the handle includes a guard.

* * * * *